US011189972B2

(12) United States Patent
Casher et al.

(10) Patent No.: US 11,189,972 B2
(45) Date of Patent: Nov. 30, 2021

(54) ELECTRICAL CONNECTOR WITH STRUCTURE FOR REDUCING RESONANCES

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Patrick R. Casher, North Aurora, IL (US); Terrance F. Little, Fullerton, CA (US)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/833,666

(22) Filed: Mar. 30, 2020

(65) Prior Publication Data

US 2020/0313363 A1 Oct. 1, 2020

Related U.S. Application Data

(60) Provisional application No. 62/826,991, filed on Mar. 30, 2019.

(51) Int. Cl.
*H01R 13/6471* (2011.01)
*H01R 12/72* (2011.01)
(Continued)

(52) U.S. Cl.
CPC ..... *H01R 13/6471* (2013.01); *H01R 12/721* (2013.01); *H01R 13/2442* (2013.01);
(Continued)

(58) Field of Classification Search
CPC ..... H01R 13/6586; H01R 13/6587; H01R 13/6471; H01R 13/2442; H01R 13/41;
(Continued)

(56) References Cited

U.S. PATENT DOCUMENTS

2007/0004282 A1* 1/2007 Cohen ..... H01R 12/727 439/607.02
2008/0248658 A1* 10/2008 Cohen ..... H01R 13/6471 439/55

(Continued)

FOREIGN PATENT DOCUMENTS

| | | |
|---|---|---|
| CN | 206850102 U | 1/2018 |
| CN | 109193203 A | 1/2019 |
| CN | 109546388 A | 3/2019 |

*Primary Examiner* — Gary F Paumen
(74) *Attorney, Agent, or Firm* — Ming Chieh Chang; Wei Te Chung

(57) ABSTRACT

An electrical connector includes a housing and a pair of contact wafers. Each contact wafer includes an insulative plate and a plurality of contacts. The contacts include a plurality of grounding contacts and plural differential-pair contacts. Each contact includes a contacting section extending beyond a front edge of the plate, a tail section exposed outside of a bottom edge of the plate and a connecting section linked between the contacting section and the tail section. The plate includes a plurality of first through holes formed along the connecting section of each grounding contact, and a plurality of second through holes formed along the connecting sections of each pair of the differential-pair contacts. The first through holes and the second through hole are essentially offset from each other in both the first direction and the second direction which are perpendicular to each other.

20 Claims, 11 Drawing Sheets

(51) Int. Cl.
*H01R 13/24* (2006.01)
*H01R 13/41* (2006.01)
*H01R 13/514* (2006.01)
*H01R 13/6588* (2011.01)

(52) U.S. Cl.
CPC ..... *H01R 13/41* (2013.01); *H01R 13/514* (2013.01); *H01R 13/6588* (2013.01)

(58) Field of Classification Search
CPC . H01R 13/514; H01R 13/6588; H01R 12/721
USPC ..... 439/607.06, 607.07
See application file for complete search history.

(56) References Cited

U.S. PATENT DOCUMENTS

2010/0144169 A1* 6/2010 Glover ..... H01R 12/585 439/68
2010/0144204 A1* 6/2010 Knaub ..... H01R 13/6594 439/607.07
2011/0021082 A1* 1/2011 Kline ..... H01R 13/6471 439/660
2013/0217263 A1* 8/2013 Pan ..... H01R 13/6474 439/607.07
2014/0370723 A1* 12/2014 Laurx ..... H01R 12/716 439/76.1
2016/0013596 A1* 1/2016 Regnier ..... H01R 12/724 439/607.35
2016/0308309 A1* 10/2016 Stokoe ..... H01R 13/6587
2018/0261942 A1* 9/2018 Toh ..... H01R 13/6587
2018/0323525 A1 11/2018 Wanha et al.
2018/0323526 A1 11/2018 Ueyama
2018/0358751 A1* 12/2018 Laurx ..... H01R 13/6461
2019/0115709 A1* 4/2019 Annis ..... H01R 13/6587
2019/0305488 A1* 10/2019 Chen ..... H01R 27/02
2020/0106218 A1* 4/2020 Regnier ..... H01R 13/6586
2020/0194913 A1* 6/2020 Avery ..... H01R 13/514
2020/0266585 A1* 8/2020 Paniagua ..... H01R 13/6591
2020/0287332 A1* 9/2020 Chen ..... H01R 13/6586
2020/0287333 A1* 9/2020 Chen ..... H01R 13/514

* cited by examiner

ELECTRICAL CONNECTOR WITH STRUCTURE FOR REDUCING RESONANCES

CROSS REFERENCE TO RELATED APPLICATIONS

This application claims the benefit of, and priority to, U.S. Provisional Patent Application No. 62/826,991, filed Mar. 30, 2019, the contents of which are incorporated entirely herein by reference.

BACKGROUND OF THE INVENTION

1. Field of the Invention

The present invention relates generally to an electrical connector, and more particularly to the electrical connector having a structure reducing resonances in the connector, especially when the higher frequencies the contacts experience.

2. Description of Related Arts

Resonances related to the ground conductor structures in connectors are a common issue for connector designers. These resonances are typically recognized in the insertion loss and cross talk, S-Parameter, performance of connectors. Standard's requirements and customer's expectations are that the performance of connectors has no resonances within the connector application's bandwidth. For applications utilizing NRZ signaling this bandwidth is at least up to ½ the data rate in terms of frequency and for applications utilizing PAM4 signaling this would be at least up to ¼ of the data rate. Consequently, as data rates increase the resonances have to be addressed to increasing frequencies. Addressing this becomes more challenging at higher frequencies. Current known methods for improving resonance performance in connectors are based on either pushing resonances out higher in frequency and/or dampening resonances. The former is to periodically interconnect the ground terminals within the connector. The latter is to dampen the resonances with the connector wherein one know method is to use the conductive "loose" plastic which is essentially uneconomic, and another known method is to adjust the ratio of air between the adjacent two signal terminals relative to that between the signal terminal and the ground terminal, or the ratio of separation applied thereto as well.

An electrical connector having economic structure to overcome resonances is desired.

SUMMARY OF THE INVENTION

An object of the invention is to provide an electrical connector comprises an insulative housing forming a receiving slot in a vertical direction, a pair of contact wafers side by side stacked and retained to the insulative housing. Each of the contact wafers comprises an insulative plate and a plurality of contacts embedded within the insulative plate. The plurality of contacts comprises a plurality of grounding contacts and plural differential-pair contacts alternately arranged with each other along the vertical direction. Each contact includes a contacting section extending beyond a front edge of the insulative plate and into the receiving slot, a tail section exposed outside of a bottom edge of the insulative plate and a connecting section linked between the contacting section and the tail section. The insulative plate includes a plurality of first through holes formed along the connecting section of each grounding contact and exposing to an outer exterior in a thickness direction of the insulative plate, and a plurality of second through holes formed along the connecting sections of each pair of the differential-pair contacts and exposing to an outer exterior in the thickness direction. The first through holes and the second through hole are essentially offset from each other in both the first direction and the second direction which are perpendicular to each other.

DETAILED DESCRIPTION OF THE PREFERRED EMBODIMENT

Figure 1:
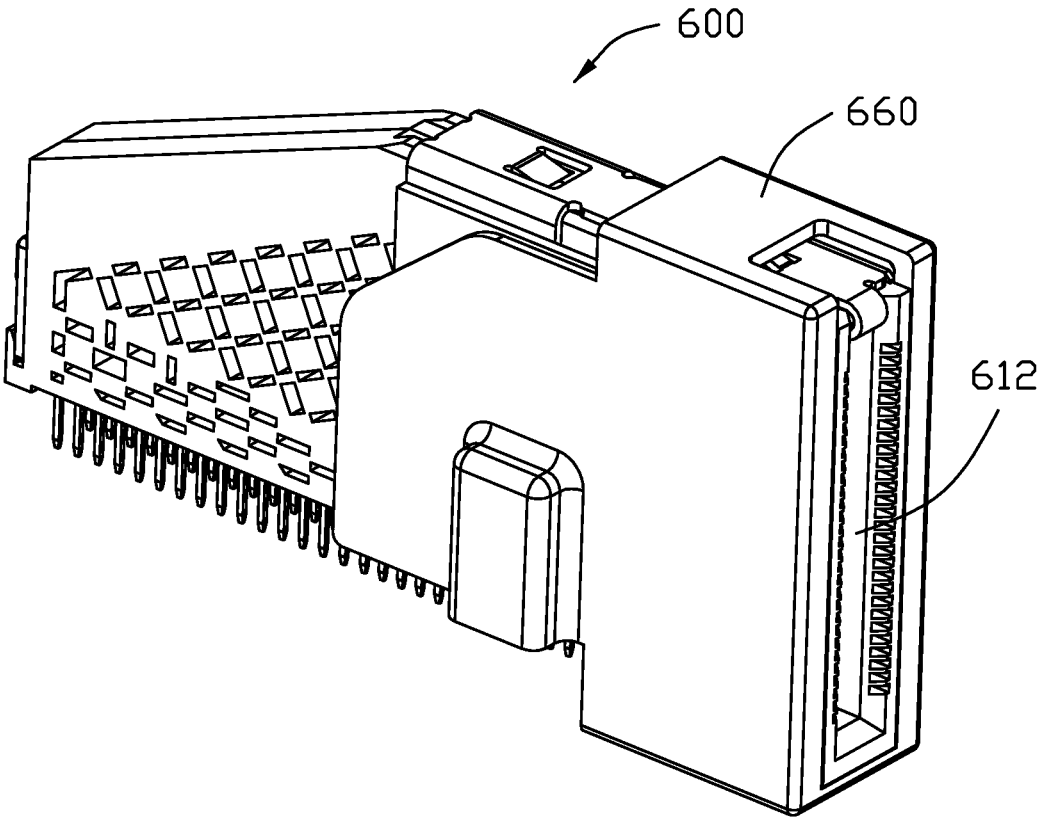
FIG. 1 is a perspective view of an electrical connector according to a preferred embodiment of the invention.
Figure 2:
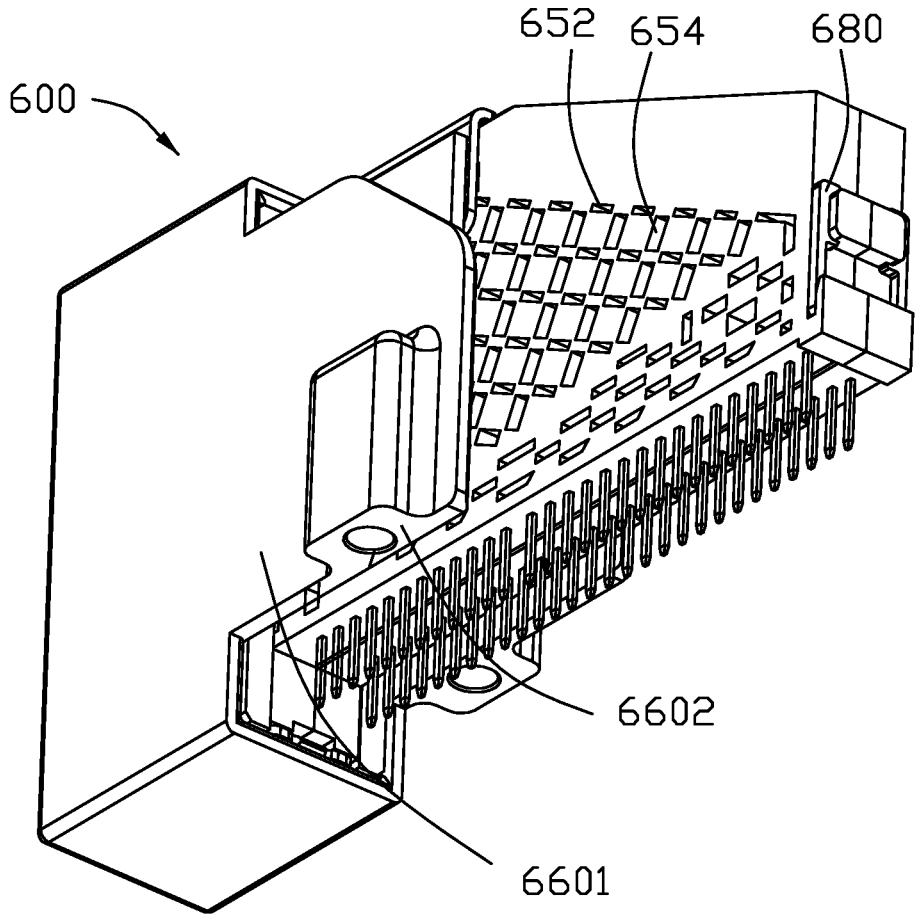
FIG. 2 is another perspective view of the electrical connector of FIG. 1.
Figure 3:
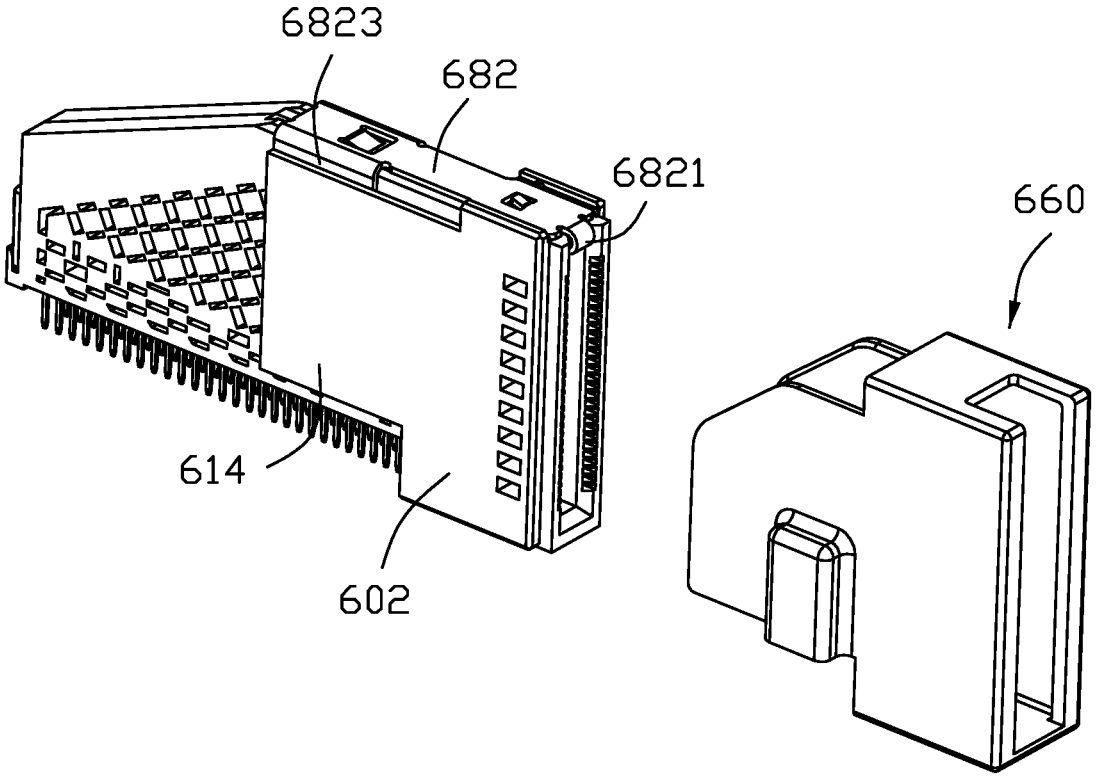
FIG. 3 is an exploded perspective view of the electrical connector of FIG. 1.
Figure 4:
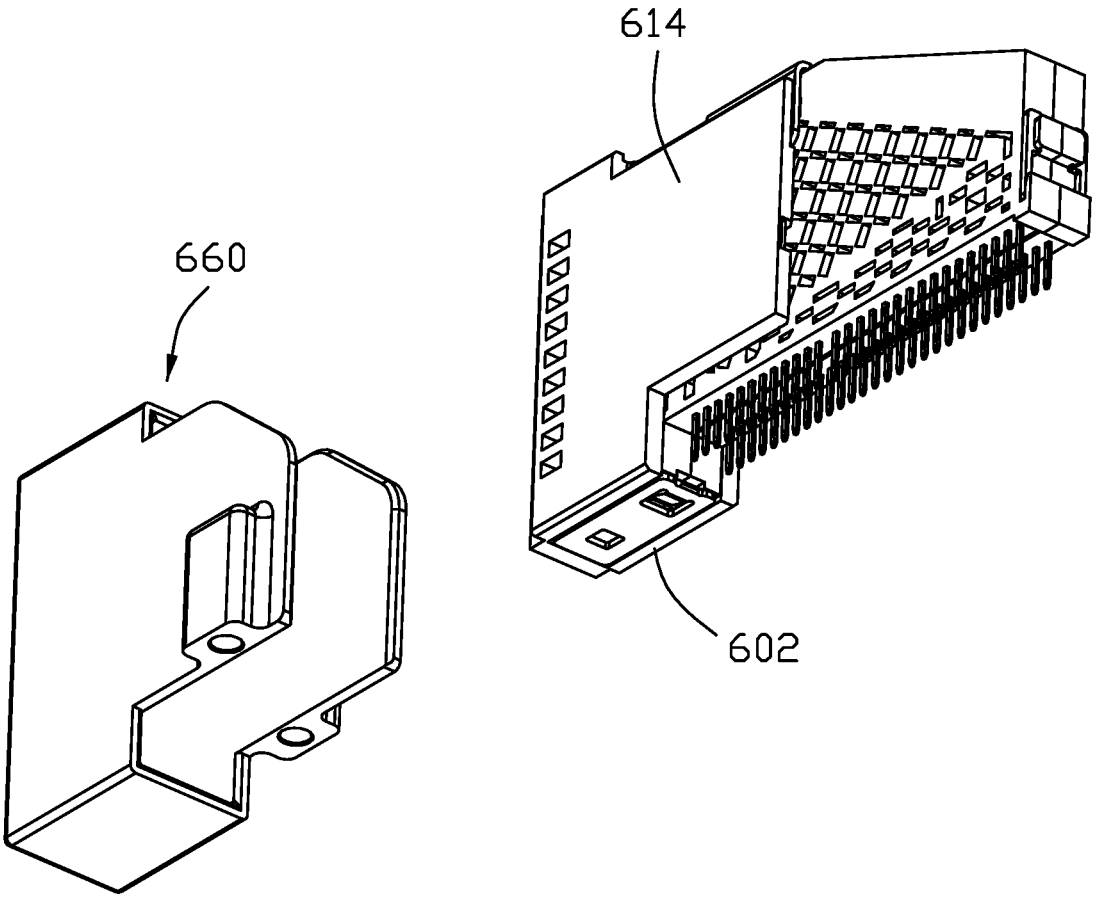
FIG. 4 is another exploded perspective of the electrical connector of FIG. 3.
Figure 5:
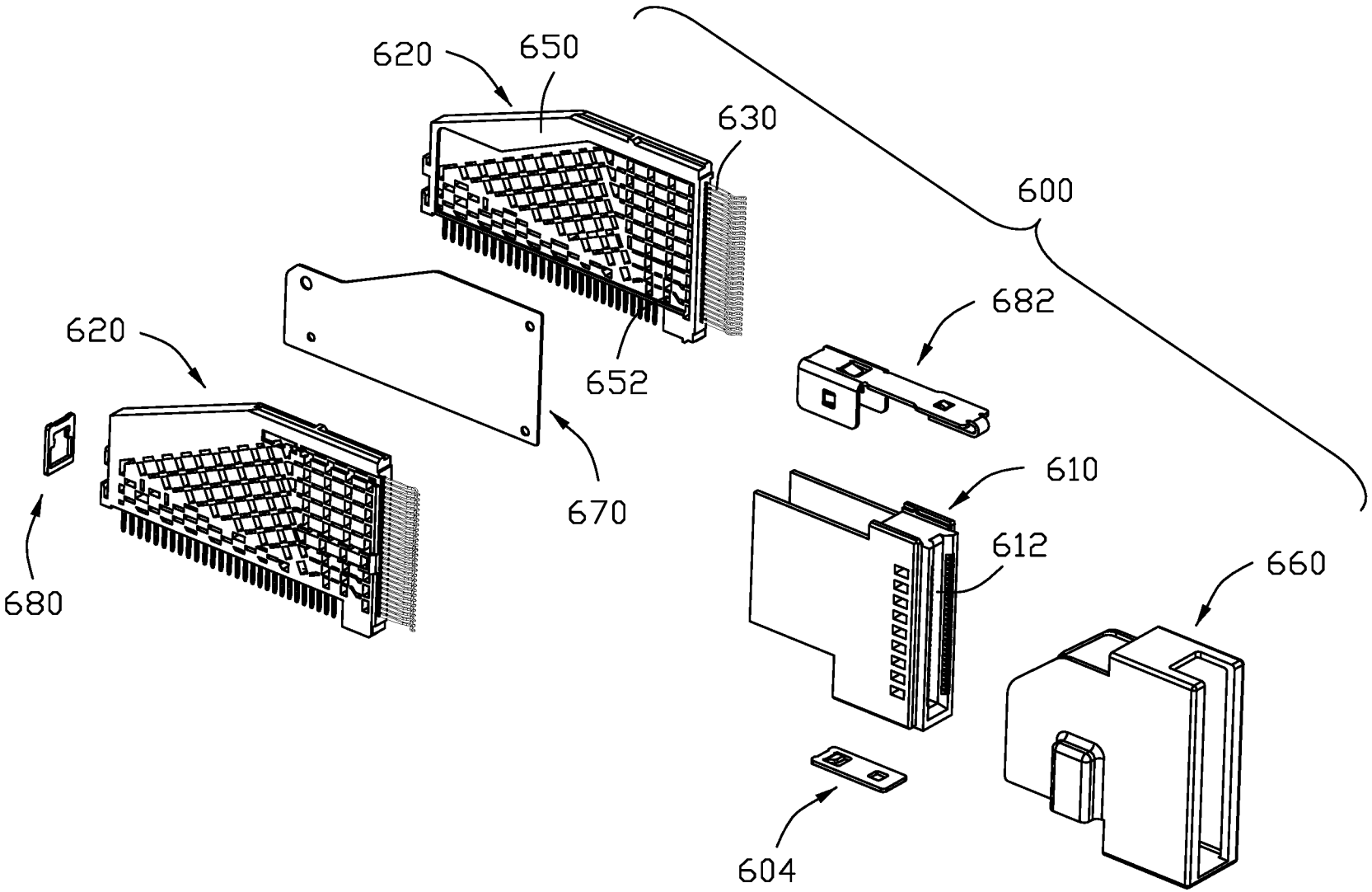
FIG. 5 is a further exploded perspective view of the electrical connector of FIG. 1.
Figure 6:
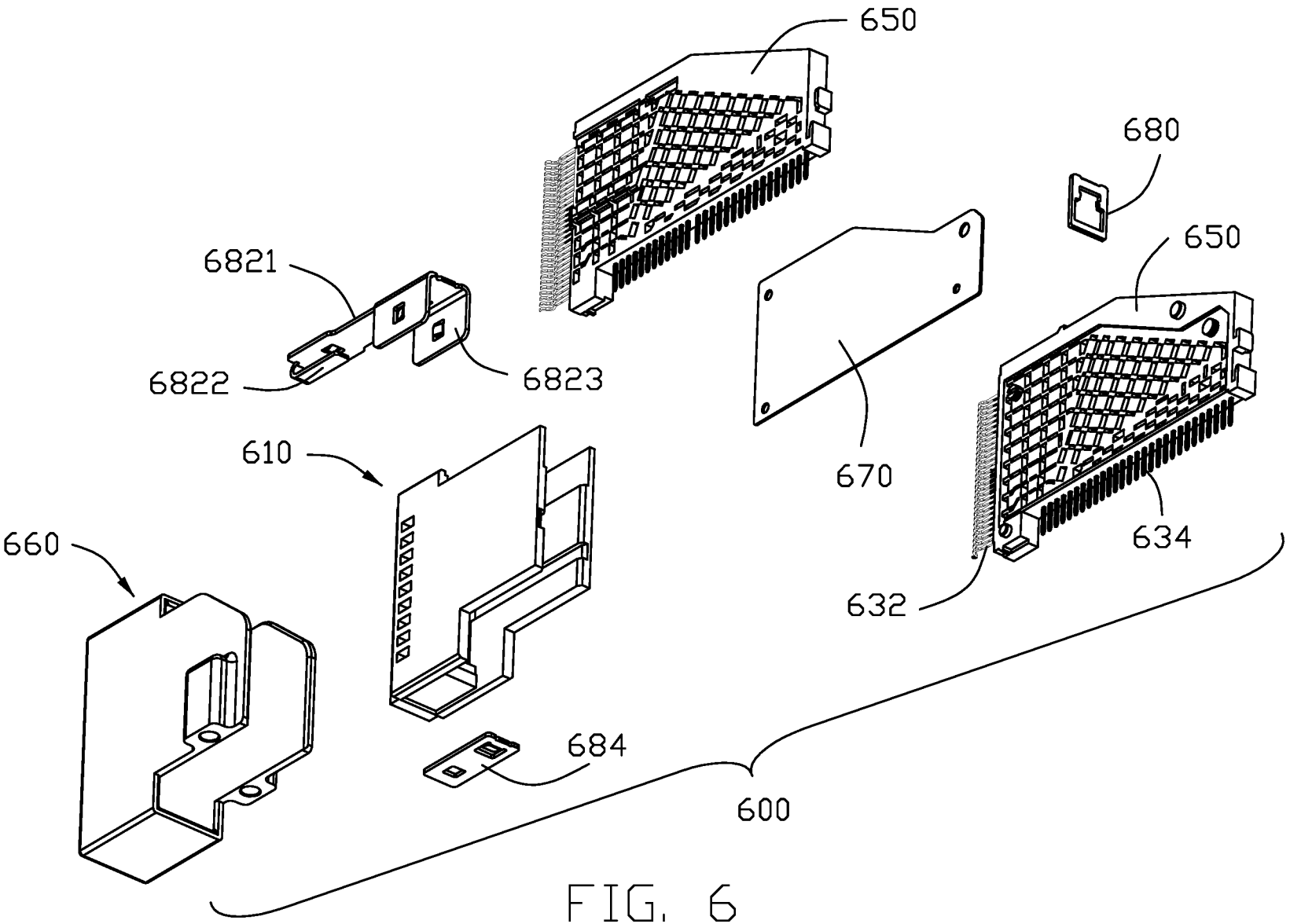
FIG. 6 is another exploded perspective view of the electrical connector of FIG. 5.

Referring to FIGS. 1 through 11, an electrical connector 200 of this invention is illustrated, and as best shown in FIGS. 5-6, the connector includes an insulative housing 610 forming a receiving slot 612 along a longitudinal/vertical direction. A pair of contact wafers 620 are retained to the housing 610 and side by side stacked to each other in a transverse direction perpendicular to the vertical direction. Each of the contact wafers 620 is essentially composed of a plurality of contacts 630 embedded within an insulative plate 650. The contacts 630 include essentially a plurality of grounding contacts 630G and plural differential-pair contacts 630S alternately arranged with each other along the longitudinal direction. Each of the contacts 630 includes a front resilient contacting section 632 extending beyond the front edge of the plate 650 in a front-to-back direction perpendicular to both the vertical direction and the transverse direction and into the receiving slot 612, a rear tail section 634 exposed outside of the bottom edge of the plate 650 in a vertical direction perpendicular to the longitudinal direction, and a middle connecting section 636 linked between the contacting section 632 and the tail section 634.

Figure 7:
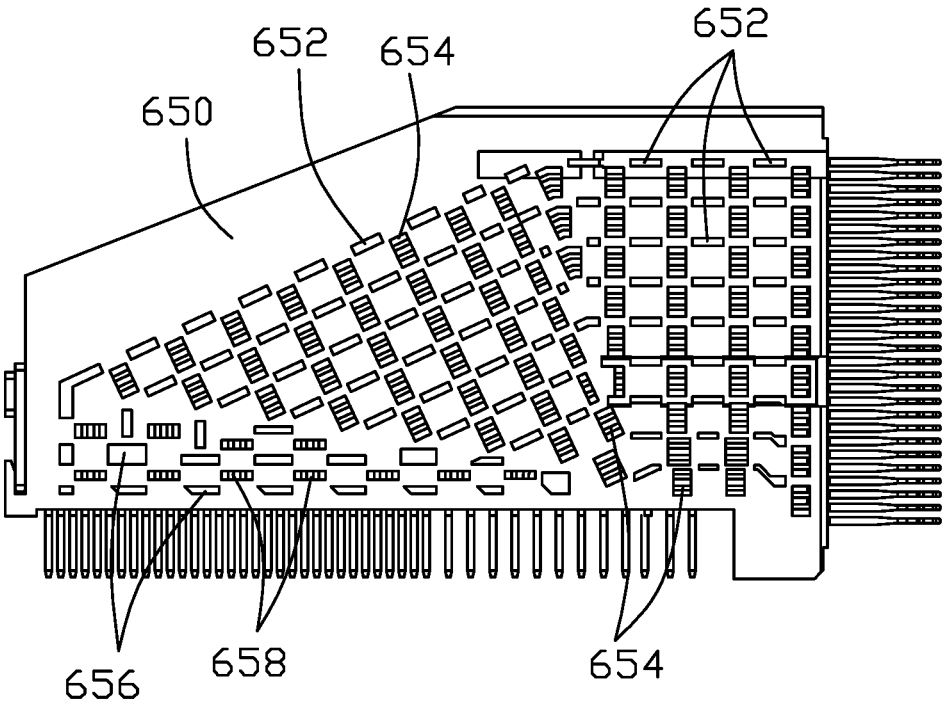
FIG. 7 is a side view of a contact wafer of the electrical connector of FIG. 1.

The insulative plate 650 includes a plurality of first through holes 652 formed along the connecting section 636 of each grounding contact 630G and extending therethrough in the transverse direction, i.e., the thickness direction of the plate, and a plurality of second through holes 654 formed along the connecting sections 636 of each set of the differential-pair contacts 630S and extending therethrough in the transverse direction. The first through holes 652 and the second through hole 654 are essentially offset from each other in both the first direction and the second direction which are perpendicular to each other wherein the first direction extends along an extension direction of the connecting section 636 while the second direction extends along a lateral/spanned direction in which the connecting sections 636 of the contacts 630 are spaced from one another. Therefore, the first direction and the second direction are perpendicular to each other. Notably, the connecting sections 636 of the contacts 630 are categorized with three zones each having the different first direction from others wherein the extension direction of the connecting section 636 in the zone closer to the tail section 634 extends in a vertical direction, that in the zone closer to the contacting section 632 extends in a horizontal/front-to-back direction, and that of the zone therebetween extends in an oblique direction, as shown in FIGS. 13 and 14. That is to say, the connecting sections 636 include horizontal portions 6361, slant portions 6362 and upright portions 6363, the tail sections 634 extend downward from the upright portions 6363 and the contacting sections 632 extend forward from the horizontal portions 6361. Some contacts near to the front edge are omitted the upright portions. The insulating plate further includes a plurality of third through hole 656 and a plurality of fourth through holes 658, located at the upright portions of the contacts, as shown in FIG. 7, and the third and fourth through holes are parallel to each other and perpendicular to the first direction.

In this embodiment, the connecting sections 636G of the grounding contact 630G is larger/wider than connecting sections 636S of the differential-pair contacts 636S. A metallic shielding plate 670 is sandwiched between the pair of contact wafers 620 in the transverse direction. A rear fastener 680 secured the pair of contact wafers 620 together. The housing 610 and the pair of contact wafers 620 with the shielding plate 670 are assembled together as a subassembly 602. A top fastener 682 and the lower fastener 684 secure the subassembly 602 together. An enclosure 660 receives the housing 610 so as to finalize the whole connector 200. The upper fastener 682 includes an upper plate 6821, a front plate folded rearward and inserting into the receiving slot 112 and two upright plates 6823 which sandwich the two contact wafers 620. The insulative housing includes two rear boards 614 and the enclosure 660 includes two rear plates 6601. A retaining portion 6602 are formed at each rear plate 6601.

Figure 8:
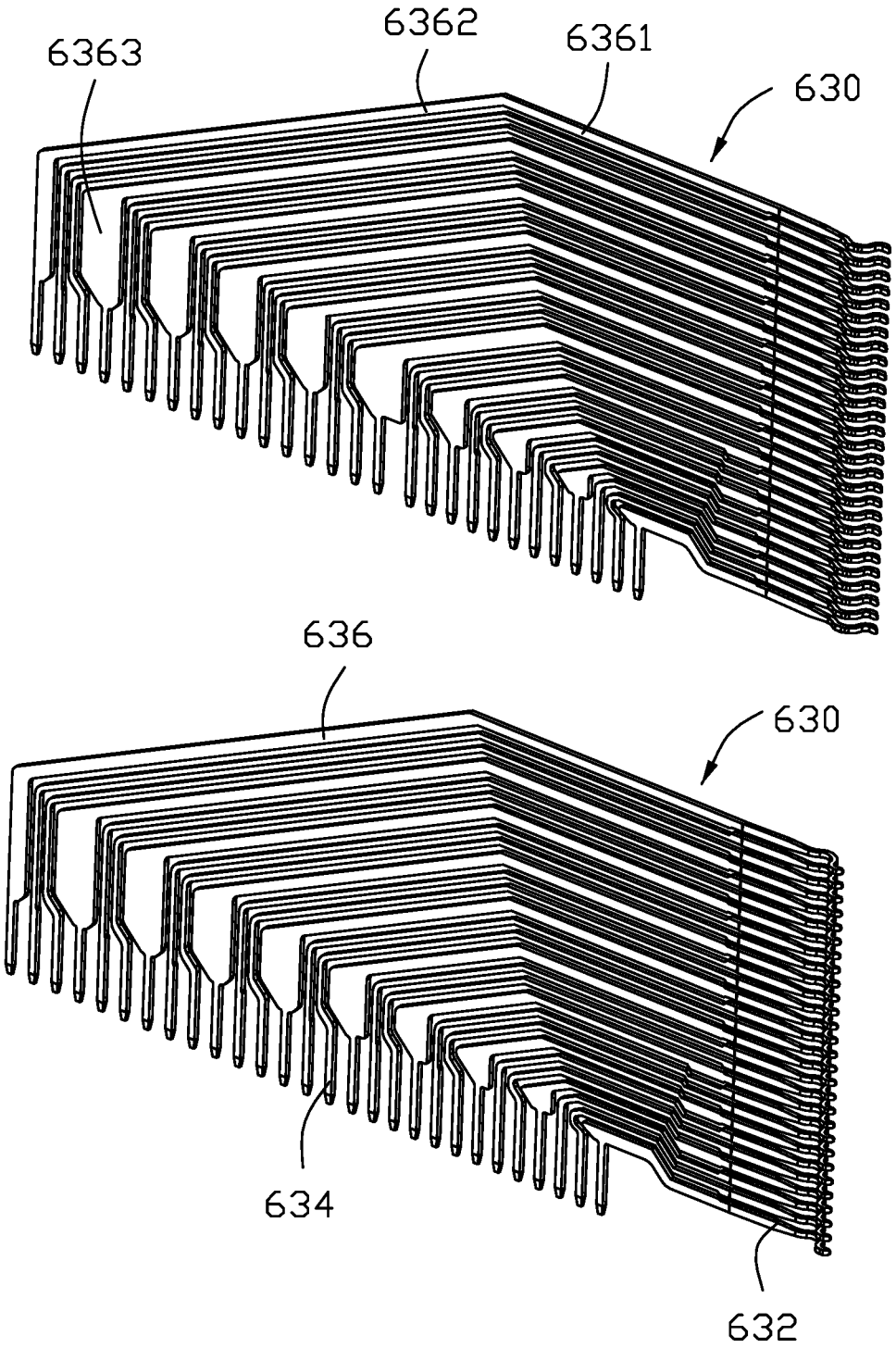
FIG. 8 is a perspective view of the contacts of the pair of contact wafers of the electrical connector of FIG. 1.
Figure 9:
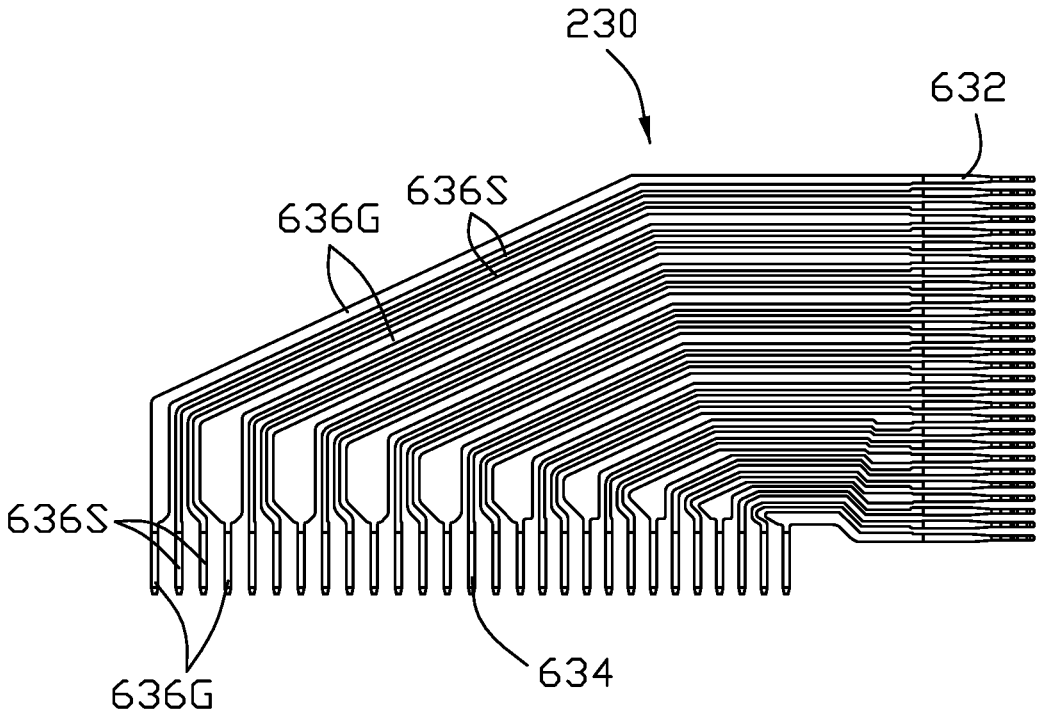
FIG. 9 is a side view of the contacts of the contact wafer of the of FIG. 8.

As shown in FIGS. 8 and 9, in this embodiment the pitch of the contact sections 632 is smaller than that of the tail section 634. Notably, the connecting section 636S of the differential pair contacts 630S essentially keeps a same pitch/width arrangement along the horizontal portion 631, the slant portion 6362 and the upright portions 6363 while the connecting sections 636G of the grounding contact 630G has an increased width of the upright portion 6363 compared with those of the horizontal portion 631 and the slant portion 6362 for improving the electrical performance. In fact, in the connecting section 636G of the grounding contact 630G, the width of the upright portion 6363 is larger than that of the slating portion 6362 which is larger than that of the horizontal portion 636. It is also noted that in each differential-pair contacts 636S, the upright portion 6363 in the outer position extends straight while that in the inner position extends in an offset manner.

Figure 10:
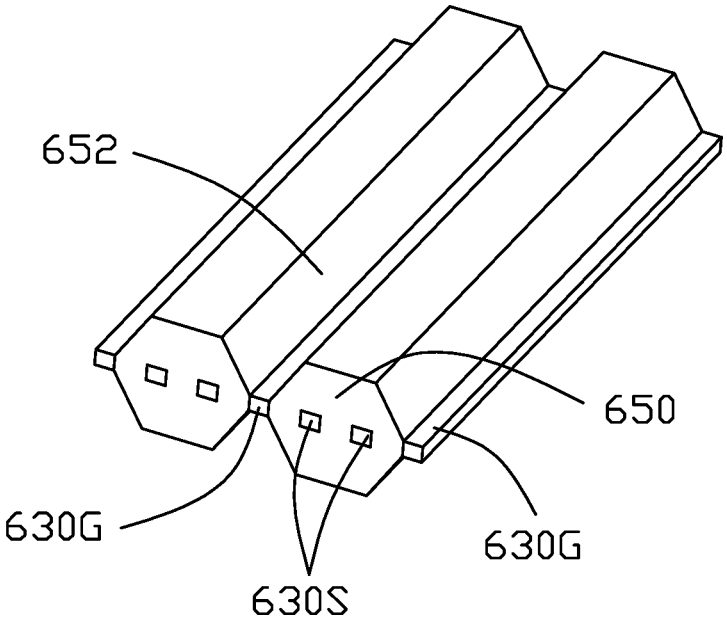
FIG. 10 is an enlarged perspective view of a portion of the contact wafer of the electrical connector of FIG. 7 to show the configuration of the first through hole.
Figure 11:
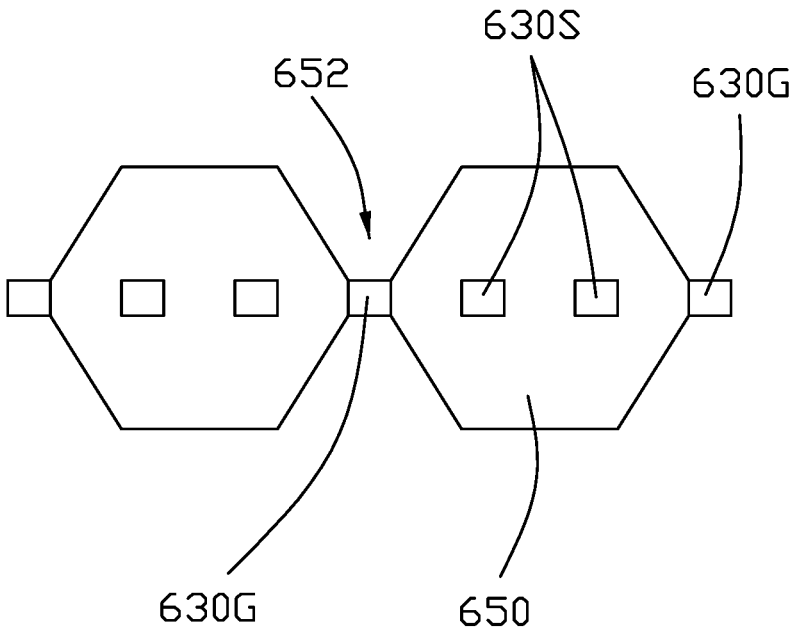
FIG. 11 is an elevational view of the portion of the contact wafer of the electrical connector of FIG. 10.

As shown in FIGS. 10 and 11, the first through hole 652 forms a tapered or an hourglass configuration rather than upstanding type, as long as opposite two outer opening of the first through hole 652 is larger than the width of the connecting section 636 of the grounding contact 630G in the second direction.

However, the disclosure is illustrative only, changes may be made in detail, especially in matter of shape, size, and arrangement of parts within the principles of the invention.

What is claimed is:

1. An electrical connector comprising:

an insulative housing forming a receiving slot extending along a vertical direction, a pair of contact wafers side by side stacked and retained to the insulative housing, each of the contact wafers comprising an insulative plate and a plurality of contacts embedded within the insulative plate, the plurality of contacts comprising a plurality of grounding contacts and plural differential-pair contacts alternately arranged with each other along the vertical direction, each contact includes a contacting section extending beyond a front edge of the insulative plate and into the receiving slot, a tail section exposed outside of a bottom edge of the insulative plate and a connecting section linked between the contacting section and the tail section;

wherein the insulative plate includes a plurality of first through holes formed along the connecting section of each grounding contact and exposing the corresponding connecting section to an exterior in a thickness direction of the insulative plate which is perpendicular to the vertical direction, and a plurality of second through holes formed along the connecting sections of each pair of the differential-pair contacts and exposing the corresponding connecting sections to said exterior in the thickness direction, the first through holes and the second through holes are essentially offset from each other in both a first direction and a second direction which are perpendicular to each other.

2. The electrical connector as claimed in claim 1, wherein in a side view, each of the first through holes is a rectangular shape while each of the second through hole is another rectangular shape different from said rectangular shape.

3. The electrical connector as claimed in claim 2, wherein each of the first through holes extends in the first direction, each of the second through holes extend along the second direction so as to expose both the connecting sections of the corresponding differential-pair contacts.

4. The electrical connector as claimed in claim 3, wherein the first direction is parallel to an extension direction of the connecting section.

5. The electrical connector as claimed in claim 4, wherein the connecting section has a horizontal portion linked to the contacting section, an upright portion linked to the tail section, and a slant section located therebetween.

6. The electrical connector as claimed in claim 1, wherein the two contact wafers sandwich a shielding plate therebetween.

7. The electrical connector as claimed in claim 1, wherein the insulative housing with the contact wafer is received in an enclosure.

8. The electrical connector as claimed in claim 1, wherein in a cross-sectional view, the first through hole forms an hourglass configuration to expose the connecting section of the corresponding grounding contact.

9. An electrical connector comprising:

at least one contact wafer located in a vertical direction and comprising an insulative plate and a plurality of contacts retained in the insulative plate, the plurality of contacts comprising plural pairs of signal contacts and a plurality of grounding contacts alternately arranged with each other along the vertical direction, each contact includes a contacting section and a tail section and a connecting section linked between the contacting section and the tail section and embedded in the insulative housing;

wherein the insulative plate includes a plurality of first through holes formed along the connecting section of each grounding contact and exposing the corresponding connecting section to an outer exterior in a thickness direction of the insulative plate which is perpendicular to a vertical direction, and a plurality of second through holes formed along the connecting sections of each pair of the signal contacts and exposing the corresponding connecting sections to said outer exterior in the thickness direction, wherein each of the first through holes defines an elongated configuration extending in a first direction along which the connecting sections of the contacts extend while each of the second through holes defines another elongated configuration extending in a second direction.

10. The electrical connector as claimed in claim 9, wherein the first direction and the second direction are perpendicular to each other.

11. The electrical connector as claimed in claim 10, wherein the first through hole and the second through hole are each in a rectangular shape.

12. The electrical connector as claimed in claim 9, wherein the connecting section includes a horizontal portion from which the contacting section extends, an upright portion from which the tail section extends, and a slanting portion linked between the horizontal portion and the upright portion.

13. The electrical connector as claimed in claim 12, wherein the insulating plate further includes a plurality of third through hole and a plurality of fourth through holes located at the upright portions of the contacts, the third and fourth through holes are parallel to each other and perpendicular to the first direction.

14. The electrical connector as claimed in claim 12, wherein a pitch defined by the contacting sections of the contacts is smaller than that defined by the tail sections, and a width of the connecting section of the pair of signal contacts keeps the same along the horizontal portion, the slanting portion and the upright portion while that of the connecting section of the grounding contact is increased along the upright portion compared with those of the connecting section of the grounding contact along the horizontal portion and the slanting portion.

15. The electrical connector as claimed in claim 9, wherein in a cross-sectional view, the first through hole is tapered or of an hourglass configuration.

16. An electrical connector comprising:

an insulative housing forming a receiving slot extending along a vertical direction, a pair of contact wafers side by side stacked and retained to the insulative housing, each of the contact wafers comprising an insulative plate and a plurality of contacts embedded within the insulative plate, the plurality of contacts comprising a plurality of grounding contacts and plural differential-pair contacts alternately arranged with each other along the vertical direction, each contact includes a contacting section extending beyond a front edge of the insulative plate and into the receiving slot, a tail section exposed outside of a bottom edge of the insulative plate and a connecting section linked between the contacting section and the tail section; wherein the insulative plate includes a plurality of first through holes formed along the connecting section of each grounding contact and exposing the corresponding connecting section to an exterior in a thickness direction of the insulative plate which is perpendicular to the vertical direction, and a plurality of second through holes formed along the connecting sections of each pair of the differential-pair contacts and exposing the corresponding connecting sections to said exterior in the thickness direction; wherein the connecting section of each of the plurality of contacts includes a horizontal portion from which the extends, an upright portion from which the tail section extends, and a slanting portion linked between the horizontal portion and the upright portion, a pitch defined by the contacting sections of the contacts is smaller than that defined by the tail sections, and a width of the connecting section of the pair of signal contacts keeps the same along the horizontal portion, the slanting portion and the upright portion while that of the connecting section of the grounding contact is increased along the upright portion compared with those of the connecting section of the grounding contact along the horizontal portion and the slanting portion.

17. The electrical connector as claimed in claim 16, wherein the housing is received within an enclosure.

18. The electrical connector as claimed in claim 16, wherein the first through holes extends in a first direction parallel to an extension direction of the connecting section while the second through hole extends in a second direction perpendicular to the first direction.

19. The electrical connector as claimed in claim 16, wherein in each differential-pair contacts, the upright portion in the outer position extends straight while that in the inner position extends in an offset manner.

20. The electrical connector as claimed in claim 16, wherein in the connecting section of the grounding contact, the width of the slanting portion is larger than that of the horizontal portion.

* * * * *